US007340800B2

(12) United States Patent
Gulley

(10) Patent No.: US 7,340,800 B2
(45) Date of Patent: Mar. 11, 2008

(54) THREE-PIECE BARREL HINGE

(75) Inventor: Thomas Dean Gulley, Monrovia, CA (US)

(73) Assignee: Sierra Pacific Engineering and Products, Rancho Dominguez, CA (US)

( * ) Notice: Subject to any disclaimer, the term of this patent is extended or adjusted under 35 U.S.C. 154(b) by 0 days.

(21) Appl. No.: 10/080,818

(22) Filed: Feb. 22, 2002
(Under 37 CFR 1.47)

(65) Prior Publication Data

US 2003/0159248 A1 Aug. 28, 2003

(51) Int. Cl.
*E05D 11/00* (2006.01)

(52) U.S. Cl. ..... 16/273; 16/274; 16/386

(58) Field of Classification Search ..... 16/273, 16/261–263, 386, 229–231, 274; 403/292–294, 403/121, 119

See application file for complete search history.

(56) References Cited

U.S. PATENT DOCUMENTS 132,147 A * 10/1872 Dodge ..... 16/274
470,514 A * 3/1892 Simpson ..... 285/382.2
853,507 A * 5/1907 Fielding ..... 16/329
1,433,095 A * 10/1922 Peary ..... 16/274
4,307,486 A * 12/1981 Matsumoto ..... 16/261
4,573,239 A * 3/1986 Valenti et al. ..... 16/273
5,561,886 A * 10/1996 Flamme ..... 16/265
5,771,538 A * 6/1998 Huppert, Sr. ..... 16/274
5,774,938 A * 7/1998 Kent et al. ..... 16/332
6,460,220 B1 * 10/2002 Jackson ..... 16/285

* cited by examiner

*Primary Examiner*—William L. Miller
(74) *Attorney, Agent, or Firm*—Christie, Parker & Hale, LLP.

(57) ABSTRACT

A barrel hinge having a female barrel portion and two male barrel portions. The female barrel portion has a sidewall with an aperture formed therein, a length, two ends, and an outside surface, and an axial bore, with an interior wall surface and a diameter, which extends from end to end. The male barrel portions each have a main body portion with an outer surface, and a pin extension. The pin extensions have a pin length and pin diameter, the pin extensions having ends, the pin diameter being sized to be received within the interior bore of the female barrel portion. The sum of the pin lengths of the pin extensions of the first and second barrel portions is less than the length of the interior bore of the female barrel portion. When the pin extensions of the two male barrel portions are fully inserted into the interior bore of the female barrel portion, a grease reservoir cavity is defined by the space between the ends of the first and second pin extensions and the interior bore and is in the vicinity of the aperture in the sidewall of the female barrel portion. A lubricant fitting is affixed within the aperture in the sidewall of the female barrel portion.

15 Claims, 6 Drawing Sheets

5
14a
10
22
12
14b
5

30a
32a
14a
26a
24a
16
18
22
20
24b
10
26b
28b
14b
32b
30b

THREE-PIECE BARREL HINGE

BACKGROUND OF THE INVENTION

The invention relates to hinges, and more particularly to barrel hinges.

Barrel hinges are widely used in applications that require hingeably attaching heavy structures together, such as ingress and egress ramps for horse trailers, ramps for earth-moving equipment trailers, and the like.

In order to provide for lubrication of barrel hinges, grease fittings can be included in the hinge designs by being attached to ends of a shaft, with a grease channel provided through the shaft so that grease can be released between the pin and the sleeve. However, for long barrel hinges, it can be costly and difficult to bore a grease channel through the pin for delivery of grease between the pin and the sleeve of the barrel hinge.

Prior art barrel hinges having three sleeve sections have been made by providing three separate sleeves made of seamless tubing and an elongate rod which is retained within bores of the sleeves. Once assembled, the two end sleeves are welded at their ends to the ends of the rod, leaving the intermediate sleeve to freely rotate. These welds require additional labor and are more prone to corrosion than the unwelded portions. These prior designs do not lend themselves to lubrication by use of the grease fitting and therefore requires manual frequent lubrication, or more typically, remain unlubricated. Furthermore, seamless tubing is more costly than seamed tubing.

Accordingly, there remains a need for an improved barrel hinge that is easier to manufacture and maintain, is less prone to rust, has better lubrication properties, and has more consistent quality.

SUMMARY OF THE INVENTION

The invention provides a three-piece barrel hinge design which utilizes less seamless tubing, has better self-lubricating qualities, and has replaceable grease fittings that are not limited in their height. The invention further provides a design which is less prone to rusting and paint chipping and which is easier to set up and maintain.

These and other objects of the invention are met by providing a barrel hinge, comprising:

a female barrel portion having a sidewall with an aperture formed therein, a length, two ends, and an outside surface, and an interior bore, with an interior wall surface and a diameter, which extends from end to end;

a first and second male barrel portion, each male barrel portion having a main body portion with an outer surface, and pin extension, the pin extension having a pin length and pin diameter, the pin extensions having ends, the pin diameter being sized to be received within the interior bore of the female barrel portion, wherein the sum of the pin lengths of the pin extensions of the first and second male barrel portions is less than the length of the interior bore of the female barrel portion, such that when the pin extensions of the first and second male barrel portion are fully inserted into the interior bore of the female barrel portion, a cavity is defined by the space between the ends of the first and second pin extensions and the interior bore, which cavity is in the vicinity of the aperture in the sidewall of the female barrel portion; and a lubricant fitting affixed within the aperture in the sidewall of the female barrel portion.

DETAILED DESCRIPTION OF THE INVENTION

Figure 1:
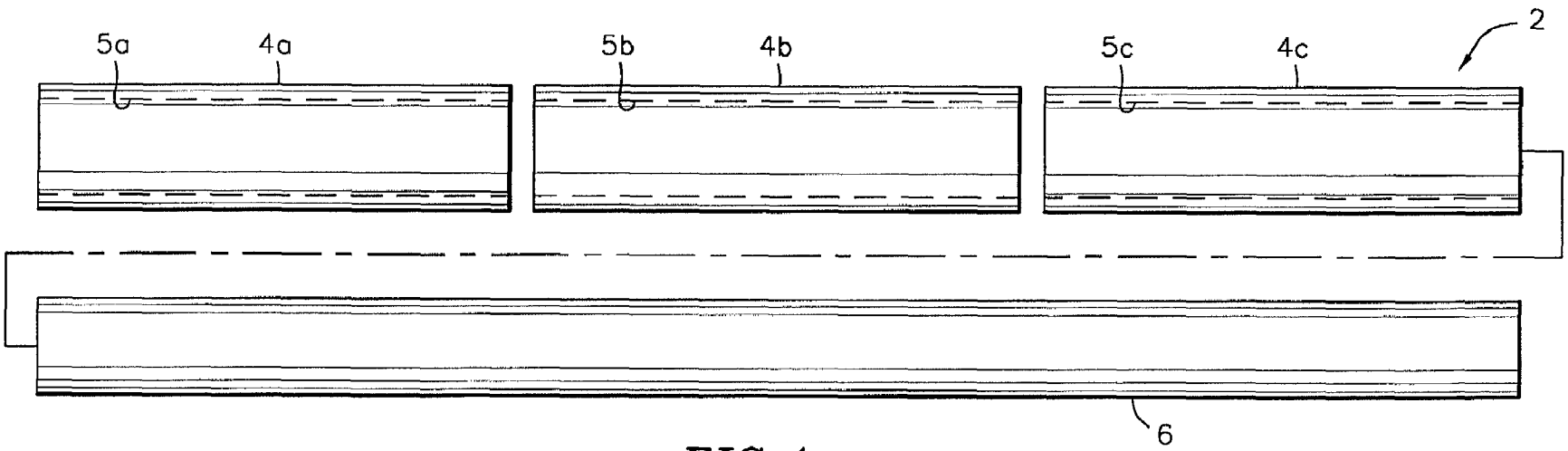
FIG. 1 PRIOR ART
FIG. 1 is an exploded view of a prior art four-piece barrel hinge design.
Figure 2:
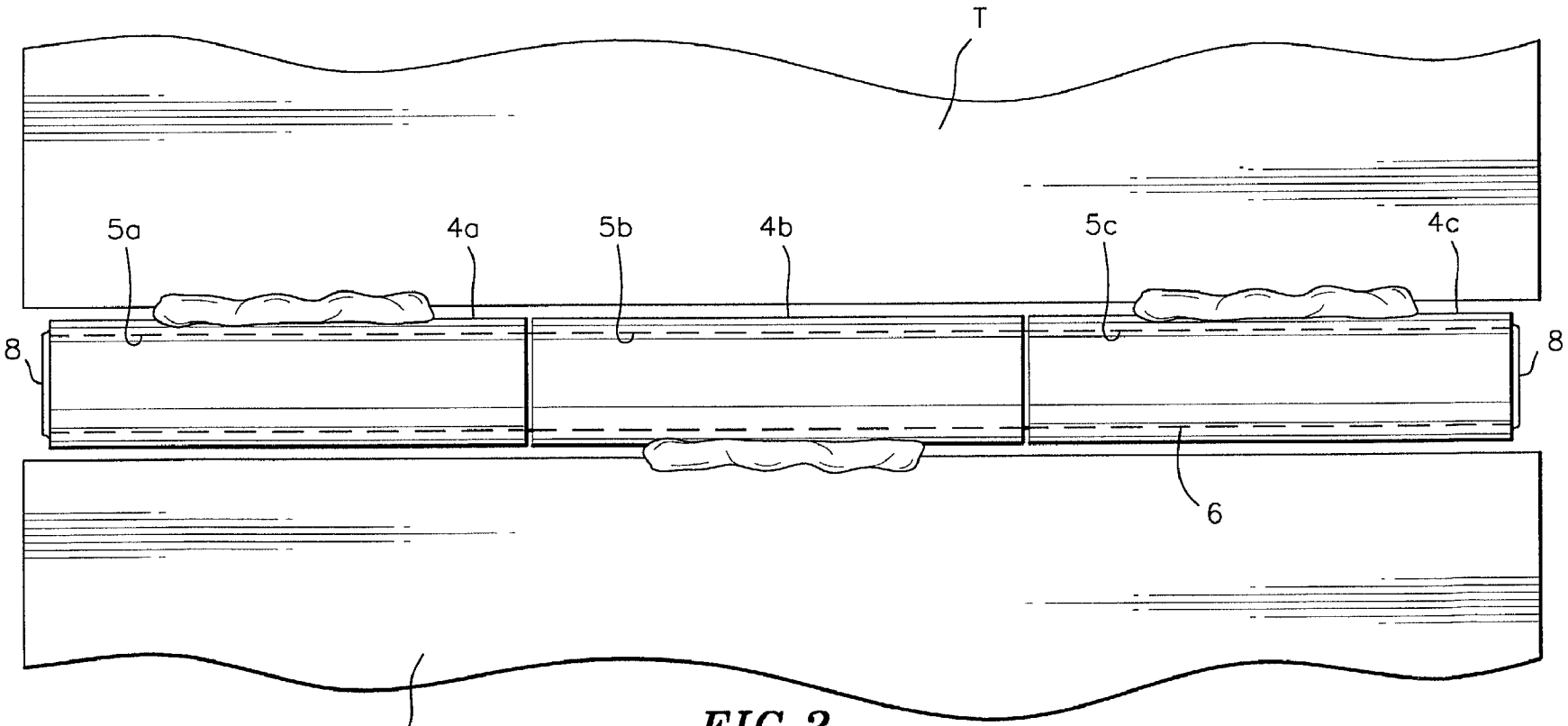
FIG. 2 PRIOR ART
FIG. 2 is a view showing the assembled prior art barrel hinge of FIG. 1, attached to a trailer and a ramp for a trailer.

Referring to FIG. 1, there is shown an exploded view of a prior art four-piece barrel hinge design, having three tube sections 4*a*, 4*b* and 4*c*, and a central pin 6 which is sized to be received within axial openings 5*a*, 5*b*, and 5*c* of the sleeves 4*a*, 4*b* and 4*c*. FIG. 2 shows pin 6 placed through axial openings 5*a*, 5*b* and 5*c* of sleeves 4*a*, 4*b* and 4*c*, with sleeves 4*a* and 4*c* being welded at their ends 8 to pin 6 to secure same together, and with barrel hinge 2 being welded to a trailer (T) and a ramp thereof (R). Pin 6 can be welded to sleeves 4*a* and 4*c* prior to attachment of the barrel hinge to the trailer and ramp, or another application. The welds 8 not only required additional assembly time, but also are more prone to rust and corrosion than unwelded areas. Furthermore, the prior art four-piece barrel hinge require that the sleeves 4*a*, 4*b*, and 4*c* be made from seamless tubing, which is more costly than seamed tubing, or utilize seamed tubing that has been machined on an inside surface thereof to remove the weld line (which can weaken the tubing). In order to provide for lubrication, a grease fitting can optionally be provided in an end of pin 6 with the grease hole formed therethrough which egresses at one or more points in the vicinity of the interface between sleeve 4*b* and the surface of pin 6 (not shown). However, this requires formation of a long channel through the center of rod which can weaken the rod and requires additional manufacturing steps. If typical grease fittings are threaded into a sidewall of the sleeve, they jut beyond the inner surface of the axial opening in the sleeve and impinge on the pin. It is therefore problematic to use grease fittings in the prior art designs. Furthermore, there is no grease reservoir provided in the prior art design since the most grease that can be retained is limited by the volume available between pin 6 and inner walls of sleeve 4*b*, which for close fitting pins and sleeves, is very small.

Figures 3, 4:
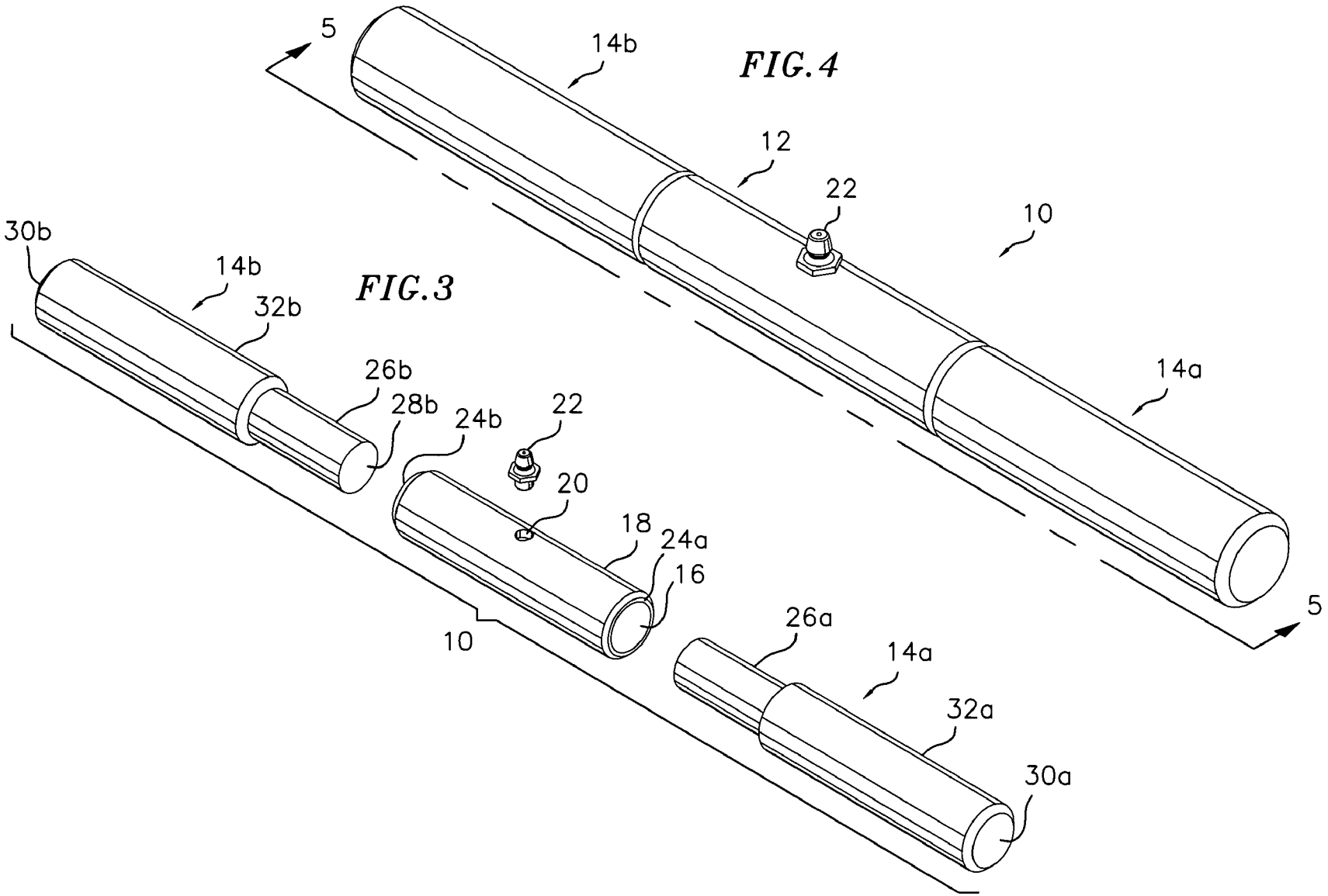
FIG. 3 is an exploded perspective view of the three-piece barrel hinge of the invention.
FIG. 4 is a perspective view of the assembled three-piece barrel hinge of the invention.

Turning to FIG. 3, there is shown an exploded view of a three-piece barrel hinge of the invention 10, which includes a female barrel 12, and two male barrels 14*a* and 14*b*. Female barrel has a cylindrical and axially located bore 16 formed therethrough from end to end (24*a* through 24*b*). Female barrel has an outer surface 18 and preferably has a threaded orifice 20 formed therein for receiving a grease fitting 22 therein. Female barrel 12'*s* bore 16 has a predetermined interior diameter.

Male barrels 14*a* and 14*b* have cylindrical pin extension 26*a* and 26*b* having front faces 28*a* and 28*b*, the diameter of which is slightly smaller than that of the interior diameter of opening 16. Male barrels 14*a* and 14*b* have opposite ends 30*a* and 30*b*, and have exterior surfaces 32*a* and 32*b* which were available for welding. Male barrels are preferably identical. Outer surface 18 of female barrel is likewise available for welding to another structure.

Referring to FIG. 4, there is a perspective view showing the three-piece barrel of the invention with pin extensions 26*a* and 26*b* of pin extensions male barrels 14*a* and 14*b* inserted into opening 16 of female barrel 12 and with grease fitting 22 engaged with threaded opening 20 of female barrel 12.

Figure 5:
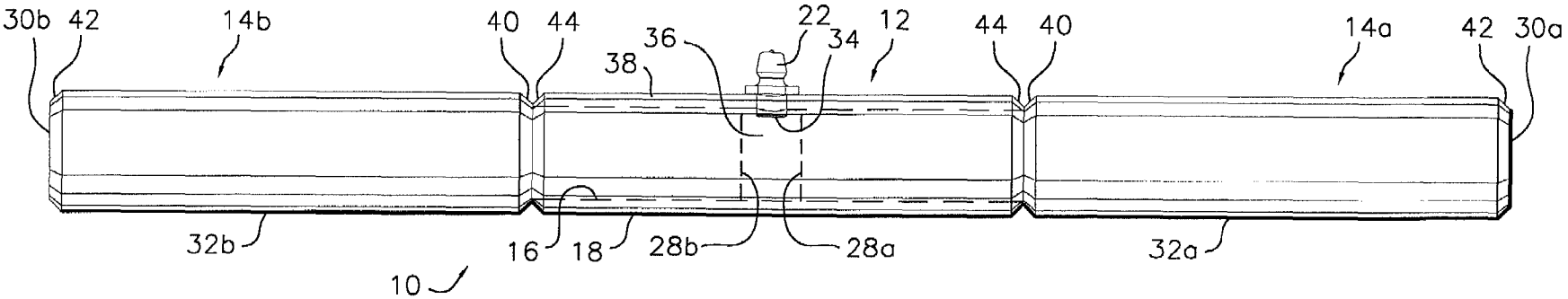
FIG. 5 is a partially exposed side view of the three-piece barrel hinge of the invention.

Turning to FIG. 5, there is shown a partial cross-sectional view through view lines 5-5 of FIG. 4, showing the assembled three-piece barrel hinge, with the female barrel 12 exposed. As can be seen, ends 28*a* and 28*b* are spaced apart from each other and define a cavity 36 therebetween within female barrel 12. End faces 28*a* and 28*b* of pin extension 26*a* and 26*b* of male barrels 14*a* and 14*b* are sized so that their ends are spaced apart by a distance which is sufficient to clear any possible projection 34*a* of a grease fitting 22 into cavity 36, and also to provide a sufficient grease volume within cavity 36 so that less maintenance is required for the hinge. An end 34 of grease fitting extends through a wall 38 of female barrel 12 so that grease can be injected into cavity 36 which will serve as a grease reservoir. As grease (or any other known lubricant) is injected into cavity 36 under pressure, it will tend to flow outwardly therefrom to coat and lubricate inner surfaces of opening 16 of female sleeve 12 and outside surfaces of insert portions 26*a* and 26*b* of male barrels 14*a* and 14*b*, thereby providing for good lubrication for the moving contact surfaces.

If grease fitting 22 and/or bore 20 become damaged, grease fitting 22 can be replaced and/or hole 22 can be rethreaded without requiring removal of the barrel hinge from the trailer to which it is welded.

Figure 7:
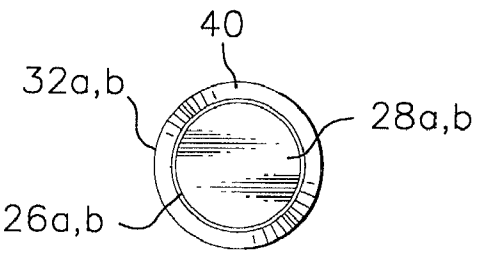
FIG. 7 is an end view along view lines 7-7 of FIG. 6.
Figure 6:
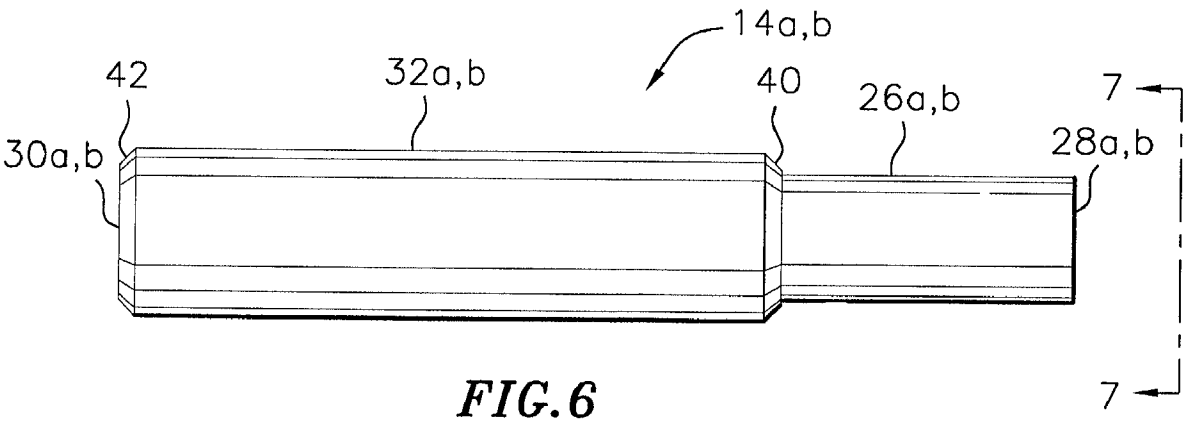
FIG. 6 is a plan view showing the female portions of the three-piece barrel hinge.

Turning to FIGS. 6 and 7, there is shown a top view of male barrel 14*a* and 14*b*. At an interface of outer surface 32*a* and 32*b* and pin extension 26*a* and 26*b*, edges thereof 40 are preferably slightly beveled to provide a paint retention surface such that when the three piece barrel is fully assembled as shown in FIGS. 4 and 5, contact between female barrel 12 and male barrels 14*a* and 14*b* will not cause paint to excessively chip off along edges 40, thereby improving the appearance of the painted hinge installed. Ends 30*a* and 30*b* can also preferably be beveled 42.

Figure 8:
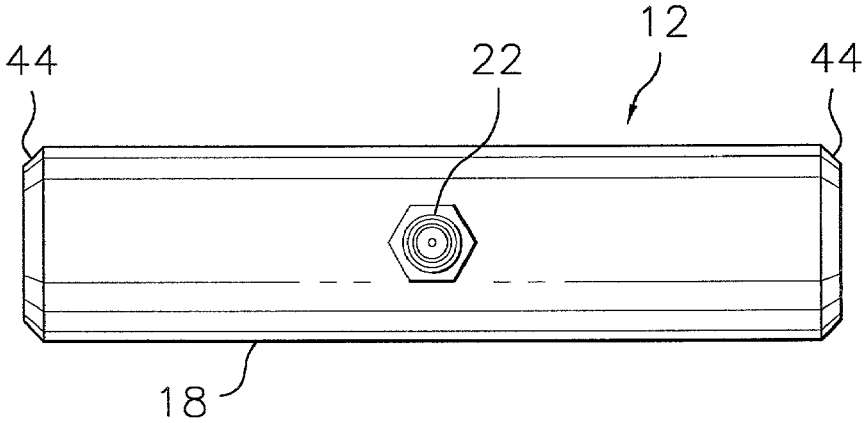
FIG. 8 is a top plan view of the female barrel of the invention with a grease fitting in place.
Figure 9:
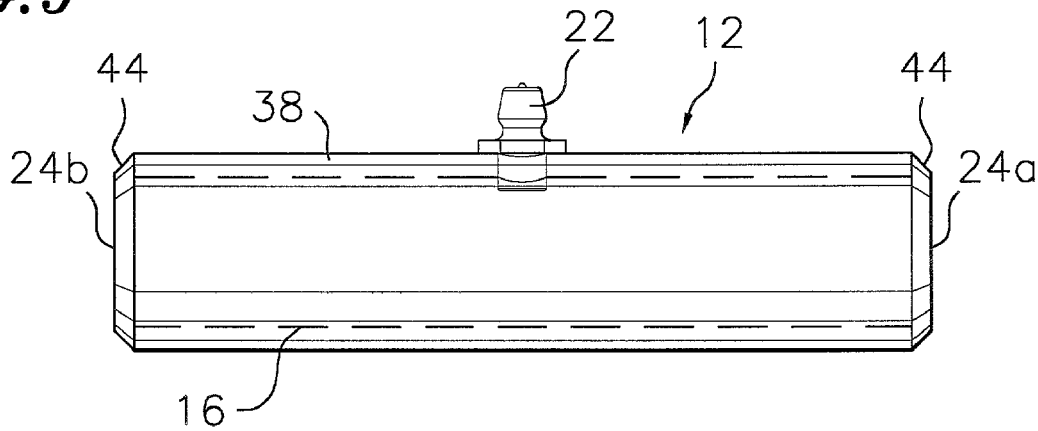
FIG. 9 is a side view of the female barrel of FIG. 8.

Turning lastly to FIGS. 8 and 9, there is shown a top plan view and an exposed side view of female barrel 12. Outer edges 44 of female barrel are also preferably beveled slightly so that when female barrel is assembled with male barrels, there was less likelihood of paint chipping along edges 40 and 42, which will provide for an improved paint longevity of the device.

In the design of the invention, since there will be better lubrication at the points of motion, the tolerances between pin extensions 26*a* and 26*b* and interior diameter 16 of female barrel can be made closer, thereby providing a more precise and smooth operating hinge.

While in practice there may be grease fittings available that do not have any portions which extend downwardly beyond inside wall 16 of female barrel, the provision of a cavity 36 is highly beneficial as a grease reservoir.

The three-piece barrel hinge design of the invention provides further advantages. For example, unlike prior art designs, only the female barrel need be assembled from seamless tubing. Since seamless tubing is more-expensive than seamed tubing, this saves money.

Male barrels 14*a* and 14*b* can be simply machined from round stock and the diameter of pin extensions 26*a* and 26*b* can be machined to be within whatever tolerances are desired of the interior diameter of female barrels 12. Furthermore, there is no welding required of a central pin which would otherwise be required to go through all three barrels of the prior art barrel hinge. This means that there is no welding required prior to attachment of the three piece barrel hinge to a trailer or other structure.

In addition to forming the male barrel portions from bar stocks, the male barrel portions can alternately be formed with thick walled tubing, with the pin extensions being machine downed to fit within the axial bore, and with plugs or caps preferably inserted into the bases of the pin extensions.

Having thus described the exemplary embodiments of the present invention, it should be understood by those skilled in the art that the above disclosures are exemplary only and that various other alternatives, adaptations, and modifications may be made within the scope of the present invention. The presently disclosed embodiment is to be considered in all respects as illustrative and not restrictive. The scope of the invention being indicated by the appended claims rather than the foregoing description, and all changes which come within the meaning and range of equivalency of the claims are, therefore, intended to be embraced therein.

What is claimed is:

1. A weld-on barrel hinge for hinging together a first item and a second item, comprising:

a cylindrical female barrel portion consisting essentially of a cylindrical sidewall with an aperture formed therein, a length, two ends, and an outside surface, and an axial bore, having an interior wall surface and a diameter, the axial bore extending from end to end, wherein the cylindrical sidewall of the cylindrical female barrel portion is welded in place to a first item;

a first and second male barrel portion, each male barrel portion consisting essentially of a cylindrical main body portion with an outer surface, and a pin extension, the pin extension having a pin length and pin diameter, the pin extensions having ends, the pin diameter being sized to be rotatably received within the axial bore of the female barrel portion, wherein the sum of the pin lengths of the pin extensions of the first and second male barrel portions is less than the length of the axial bore of the female barrel portion, such that when the pin extensions of the first and second male barrel portion are fully inserted into the interior bore of the female barrel portion, a cavity is defined by the space between the ends of the first and second pin extensions and the axial bore, which cavity is in the vicinity of the aperture in the sidewall of the female barrel portion, wherein the outer surfaces of the cylindrical main body portions of the first and second male barrel portions are welded directly in place to a second item; and a lubricant fitting affixed within the aperture in the sidewall of the female barrel portion.

2. The weld-on barrel hinge of claim 1, wherein the two ends of the female barrel portion are outwardly beveled where the outside surface meets the two ends, and wherein the main body portions of the male barrel portions are outwardly beveled where the pin extensions extend therefrom to form a groove in interface regions where the bevels at the two ends of the female barrel portion are adjacent to bevels where the pin extensions extend from the main body portions.

3. The weld-on barrel hinge of claim 1, wherein the aperture in the sidewall of the female barrel portion is threaded and the lubricant fitting is threadably engaged therewith.

4. The weld-on barrel hinge of claim 1, wherein the female barrel portion comprises a section of seamless cylindrical tubing.

5. The weld-on barrel hinge of claim 1, wherein each of the male barrel portions is formed from a section of solid bar stock with the pin extension portions being formed by machining at one end thereof.

6. The weld-on barrel hinge of claim 1, wherein each of the male barrel portions is formed from a section of solid cylindrical stock with the pin extension portions machined at one end thereof.

7. The weld-on barrel hinge of claim 1, wherein the first and second male barrel portions are identical.

8. A three-piece weld-on barrel hinge for hinging together a first item and a second item, comprising:

a cylindrical female barrel portion having a length, two ends, and a cylindrical outside surface, an axial bore with a diameter extending from end to end therethrough, and an aperture formed on a sidewall, wherein the cylindrical outside surface of the cylindrical female barrel portion is welded in place to a first item;

a lubricant fitting placed in the aperture; and a first and second male barrel portion, each male barrel portion having a cylindrical main body portion and a pin extension having a pin length, a pin diameter, and a pin end, the pin diameter being sized to be rotatably received within the axial bore of the female barrel portion, wherein when the pin extensions of the first and second barrel portions are inserted into the axial bore of the female barrel portion, the pin ends are spaced apart to define a cavity therebetween, which cavity is in the vicinity of the lubricant fitting, wherein the outer surfaces of the cylindrical main body portions of the first and second male barrel portions are welded directly in place to a second item.

9. The weld-on barrel hinge of claim 8, wherein the two ends of the female barrel portion are outwardly beveled where the outside surface meets the two ends, and wherein the main body portions of the male barrel portions are outwardly beveled where the pin extensions extend therefrom to form a groove in interface regions where the bevels at the two ends of the female barrel portion are adjacent to bevels where the pin extensions extend from the main body portions.

10. The weld-on barrel hinge of claim 8, wherein the aperture in the sidewall of the female barrel portion is threaded and the lubricant fitting is threadably engaged therewith.

11. The weld-on barrel hinge of claim 8, wherein the lubricant fitting is press fitted into the aperture in the sidewall of the female barrel portion.

12. The weld-on barrel hinge of claim 8, wherein the female barrel portion comprises a section of seamless cylindrical tubing.

13. The weld-on barrel hinge of claim 8, wherein each of the male barrel portions is formed from a section of solid bar stock with the pin extension portions being formed at one end thereof.

14. The weld-on barrel hinge of claim 8, wherein each of the male barrel portions is formed from a section of solid cylindrical stock with the pin extension portions machined at one end thereof.

15. A three-piece weld-on barrel hinge for hinging together a first item and a second item, comprising:

a female barrel portion made from a section of seamless cylindrical tubing having a length, two ends, a tubing wall with an outside surface, an interior bore with a diameter extending from end to end therethrough, and an aperture is formed in the tubing wall, wherein the outside surface of the cylindrical female barrel portion is welded in place to a first item;

a lubricant fitting affixed within the aperture in the tubing wall of the female portion;

a first and second male barrel portion, each male barrel portion having a cylindrical main body portion with an outer surface and a unitary pin extension having a pin length, a pin diameter, and a pin end, the pin diameter being sized to be received within the interior bore of the female barrel portion, wherein when the pin extensions of the first and second male barrel portions are inserted into the interior bore of the female barrel portion, the pin ends are spaced apart, and wherein the outer surfaces of each male barrel portion is directly welded to the second item without additional attachment features.

* * * * *